US005697851A

United States Patent [19]

Delgado

[11] Patent Number: 5,697,851

[45] Date of Patent: Dec. 16, 1997

[54] PORTABLE PLAYGROUND SYSTEM

[76] Inventor: Alex Delgado, 434 Stockholm Ct., Hemet, Calif. 92545

[21] Appl. No.: 674,251

[22] Filed: Jul. 1, 1996

[51] Int. Cl.[6] ..... A63G 21/00

[52] U.S. Cl. ..... 472/116; 482/35

[58] Field of Search ..... 472/116, 117, 472/136, 137; 482/35, 37

[56] References Cited

U.S. PATENT DOCUMENTS 3,485,494 12/1969 Lieberman ..... 482/35

5,326,328 7/1994 Robinson ..... 472/136

*Primary Examiner*—Kien T. Nguyen

[57] ABSTRACT

A portable playground system including a cylindrical base member having four openings therethrough disposed at ninety degree intervals therearound intermediate upper and lower ends thereof. The base member has a floor disposed interiorly thereof disposed at lower ends of the four openings. A top member is dimensioned for removable coupling with the upper end of the cylindrical base member. Stairs, ladders and slides are adapted for removably coupling with the four openings.

9 Claims, 3 Drawing Sheets

FIG. 5
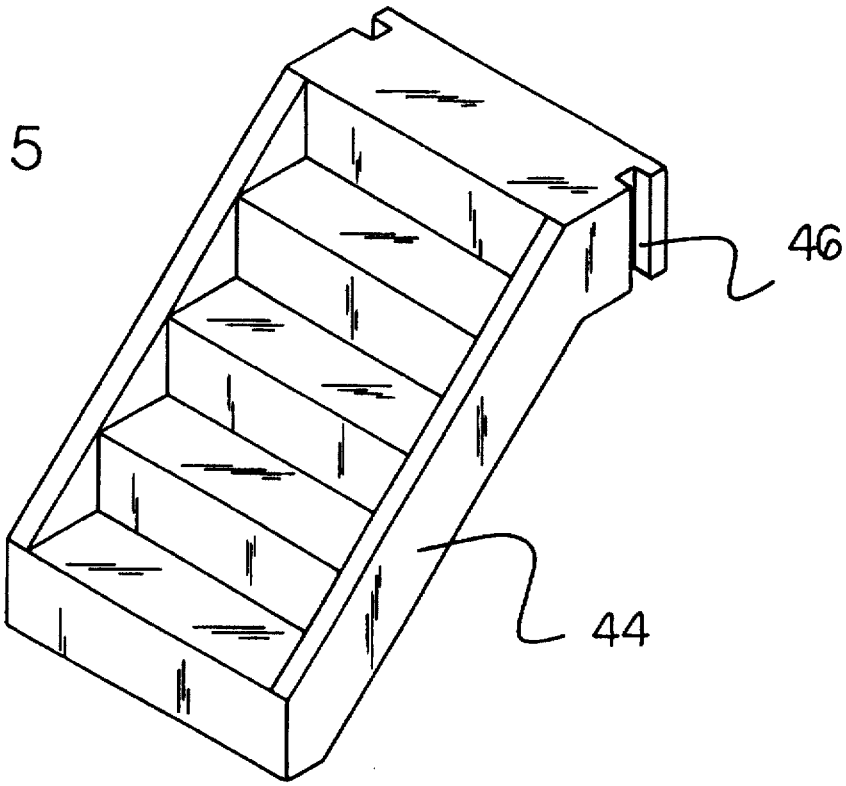
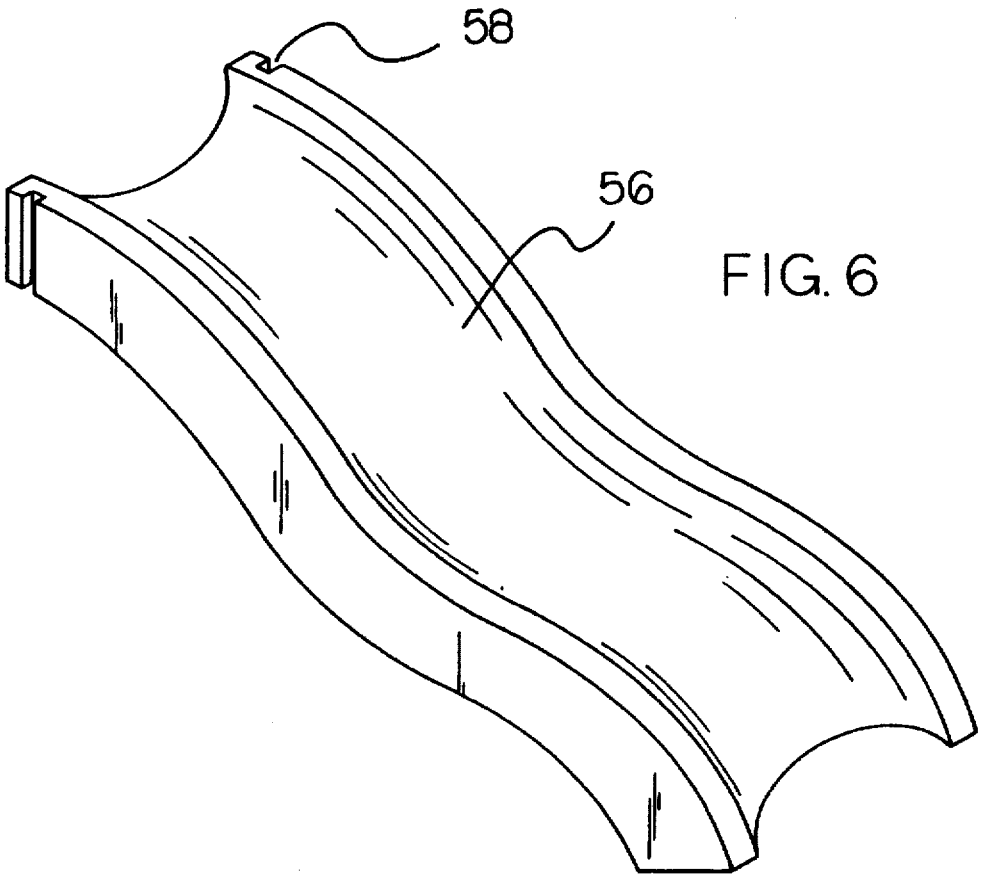
FIG. 6

PORTABLE PLAYGROUND SYSTEM

BACKGROUND OF THE INVENTION

1. Field of the Invention

The present invention relates to a portable playground system and more particularly pertains to allowing for easy assembly and disassembly for transportation with a portable playground system.

2. Description of the Prior Art

The use of playgrounds is known in the prior art. More specifically, playgrounds heretofore devised and utilized for the purpose of amusing children are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,262,900 to Vinson discloses a playground set.

U.S. Pat. No. 4,781,643 to Holloway et al. discloses a toddler tree.

U.S. Pat. No. Des. 340,273 to Ezell discloses the ornamental design for a combination playhouse, deck and slide.

U.S. Pat. No. Des. 347,458 to Cunard et al. discloses the ornamental design for a children's play gym.

U.S. Pat. No. Des. 336,674 to Baer discloses the ornamental design for a playground slide.

U.S. Pat. No. Des. 353,866 to Houry et al. discloses the ornamental design for a rectangular panel for playground structure.

While these devices fulfill their respective, particular objective and requirements, the aforementioned patents do not describe a portable playground system for allowing for easy assembly and disassembly for transportation.

In this respect, the portable playground system according to the present invention substantially departs from the conventional concepts and designs of the prior art, and in doing so provides an apparatus primarily developed for the purpose of allowing for easy assembly and disassembly for transportation.

Therefore, it can be appreciated that there exists a continuing need for new and improved portable playground system which can be used for allowing for easy assembly and disassembly for transportation. In this regard, the present invention substantially fulfills this need.

SUMMARY OF THE INVENTION

In the view of the foregoing disadvantages inherent in the known types of playgrounds now present in the prior art, the present invention provides an improved portable playground system. As such, the general purpose of the present invention, which will be described subsequently in greater detail, is to provide a new and improved portable playground system and method which has all the advantages of the prior art and none of the disadvantages.

To attain this, the present invention essentially comprises a cylindrical base member having an open upper end, an enlarged closed lower end and a cylindrical side wall therebetween. The cylindrical side wall has four openings therethrough disposed at ninety degree intervals therearound intermediate the upper end and the lower end of the base member. Each of the openings has inwardly extending flanges on opposing lower ends thereof. The cylindrical side wall has a plurality of small windows formed therethrough.

The base member has a floor disposed interiorly thereof disposed at lower ends of the four openings. The system includes a top member having a shape of a tree top. The top member has an open lower end dimensioned for removable coupling with the open upper end of the cylindrical base member. The top member has a plurality of windows formed therethrough. A pair of holding chambers are secured to an interior surface of the cylindrical side wall of the cylindrical base member extending downwardly through the floor disposed therein. A pair of stair lengths are adapted for removably coupling with two of the four openings of the cylindrical base member. The stair lengths each have an upper portion with opposed recesses therein for engagement with the inwardly extending flanges of the openings. A ladder is adapted for removably coupling with one of the four openings of the cylindrical base member. The ladder has an upper portion with opposed recesses therein for engagement with the inwardly extending flanges of one of the openings. A slide is adapted for removably coupling with one of the four openings of the cylindrical base member. The slide has an upper portion with opposed recesses therein for engagement with the inwardly extending flanges of one of the openings.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable playground system which has all the advantages of the prior art playgrounds and none of the disadvantages.

It is another object of the present invention to provide a new and improved portable playground system which may be easily and efficiently manufactured and marketed.

It is a further object of the present invention to provide a new and improved portable playground system which is of durable and reliable construction.

An even further object of the present invention is to provide a new and improved portable playground system which is susceptible of a low cost of manufacture with regard to both materials and labor, and which accordingly is then susceptible of low prices of sale to the consuming public, thereby making such a portable playground system economically available to the buying public.

Still yet another object of the present invention is to provide a new and improved portable playground system which provides in the apparatuses and methods of the prior art some of the advantages thereof, while simultaneously overcoming some of the disadvantages normally associated therewith.

Even still another object of the present invention is to provide a new and improved portable playground system for allowing for easy assembly and disassembly for transportation.

Lastly, it is an object of the present invention to provide a new and improved portable playground system including a cylindrical base member having four openings therethrough disposed at ninety degree intervals therearound intermediate upper and lower ends thereof. The base member has a floor disposed interiorly thereof disposed at lower ends of the four openings. A top member is dimensioned for removable coupling with the upper end of the cylindrical base member. Stairs, ladders and slides are adapted for removably coupling with the four openings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of the stairs of the present invention.

FIG. 6 is a perspective view of the slide of the present invention.

The same reference numerals refer to the same parts through the various Figures.

DESCRIPTION OF THE PREFERRED EMBODIMENT

Figure 1:
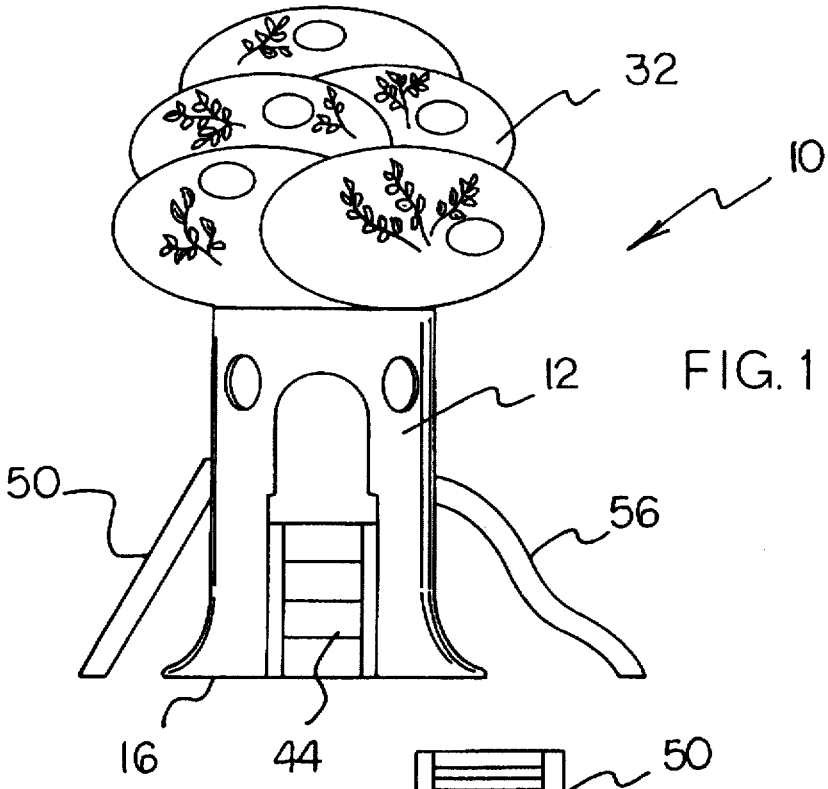
FIG. 1 is a perspective view of the preferred embodiment of the portable playground system constructed in accordance with the principles of the present invention.
Figure 2:
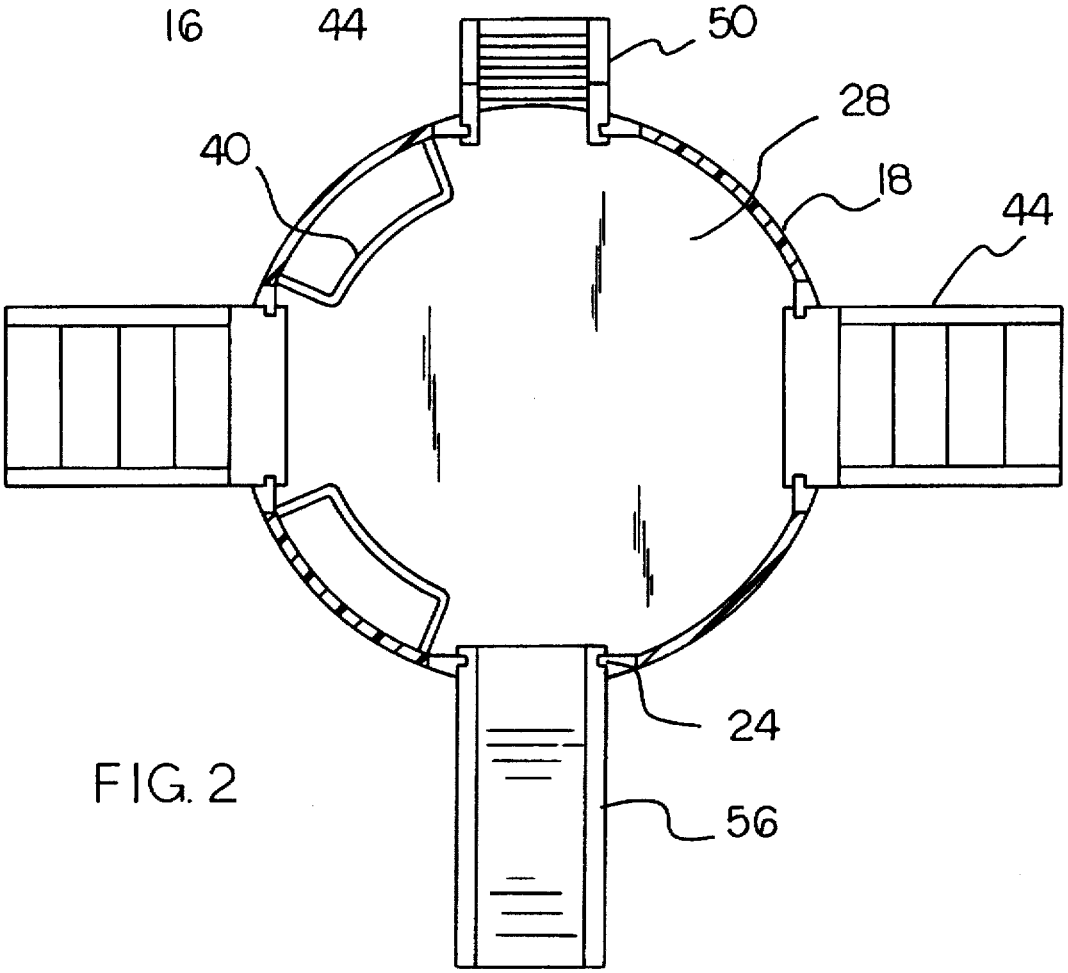
FIG. 2 is a plan view of the present invention shown in cross-section.
Figure 3:
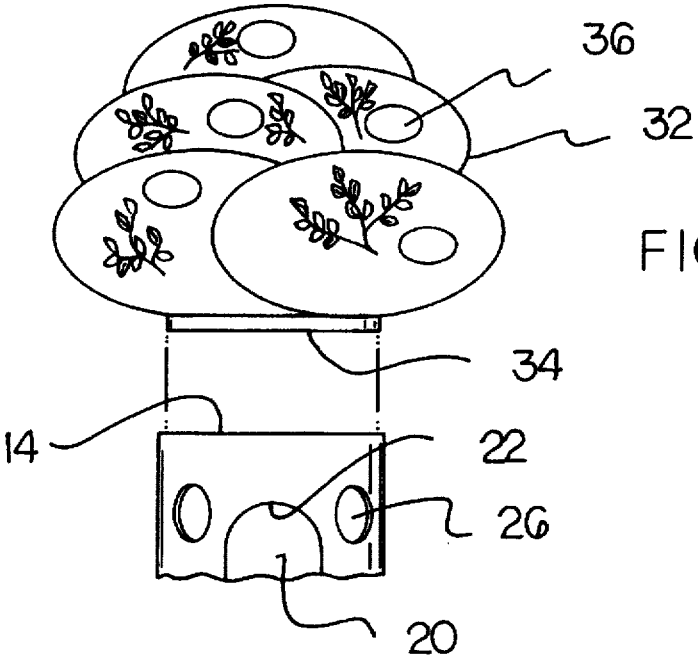
FIG. 3 is a top sectional view of the present invention.
Figure 4:
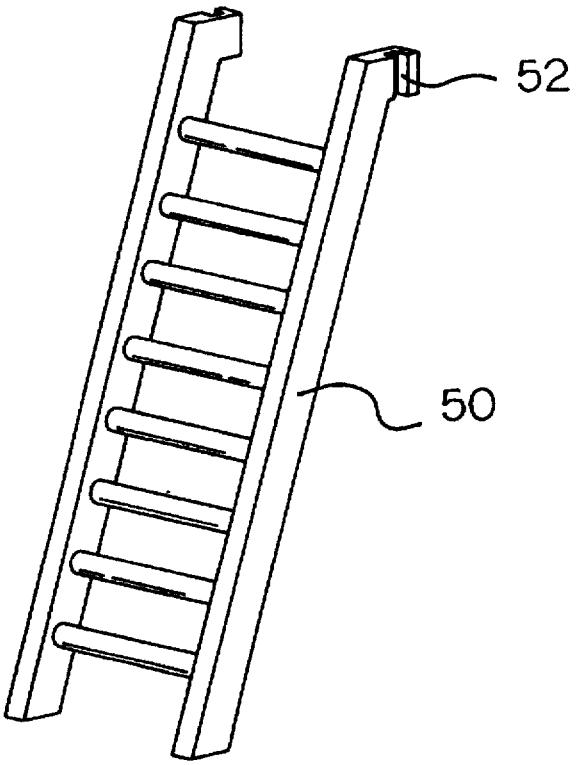
FIG. 4 is a perspective view of the ladder of the present invention.

With reference now to the drawings, and in particular, to FIGS. 1–6 thereof, the preferred embodiment of the new and improved portable playground system embodying the principles and concepts of the present invention and generally designated by the reference number 10 will be described.

Specifically, it will be noted in the various Figures that the device relates to a portable playground system for allowing for easy assembly and disassembly for transportation. In its broadest context, the system consists of a cylindrical base member, a top member, a pair of holding chambers, a pair of stair lengths, a ladder and a slide. Such components are individually configured and correlated with respect to each other so as to attain the desired objective.

The system 10 includes a cylindrical base member 12 having an open upper end 14, an enlarged closed lower end 16 and a cylindrical side wall 18 therebetween. The cylindrical base member 12 is shaped like a trunk of a tree. The enlarged closed lower end 16 serves to support the system 10 in an upright orientation. The cylindrical side wall 18 has four openings 20 therethrough disposed at ninety degree intervals therearound intermediate the upper end 14 and the lower end 16 of the base member 12. The four openings 20 serve as doors for entering into the base member 12. The openings 20 each have a rounded upper end 22 to enhance the appearance of the system 10. Each of the openings 20 has inwardly extending flanges 24 on opposing lower ends thereof. The cylindrical side wall 18 has a plurality of small windows 26 formed therethrough. The base member 12 has a floor 28 disposed interiorly thereof disposed at lower ends of the four openings 20. The floor 28 allows for children to be supported within the base member 12 at a position elevated above a ground surface the system 10 is supported upon.

In association with the base member 12, the system 10 includes a top member 32 having a shape of a tree top. The top member 32 has an open lower end 34 dimensioned for removable coupling with the open upper end 14 of the cylindrical base member 12. The top member 32 has a plurality of windows 36 formed therethrough. The top member 32 allows for a child within the base member 12 to climb within the top member 32 to peer out of one of the windows 36.

A pair of holding chambers 40 are secured to an interior surface of the cylindrical side wall 18 of the cylindrical base member 12 extending downwardly through the floor 28 disposed therein. The holding chambers 40 are used to hold balls therein whereby a child can jump safely within the holding chambers 40 from within the base member 12.

A pair of stair lengths 44 are adapted for removably coupling with two of the four openings 20 of the cylindrical base member 12. The stair lengths 44 each have an upper portion with opposed recesses 46 therein for engagement with the inwardly extending flanges 24 of the openings 20. Note FIG. 5. The stair lengths 44 allow for a child to safely enter into or exit out of the base member 12.

A ladder 50 is adapted for removably coupling with one of the four openings 20 of the cylindrical base member 12. The ladder 50 has an upper portion with opposed recesses 52 therein for engagement with the inwardly extending flanges 24 of one of the openings 20. Note FIG. 4. The ladder 50 allows for a child to safely enter into or exit out of the base member 12.

Lastly, a slide 56 is adapted for removably coupling with one of the four openings 20 of the cylindrical base member 12. The slide 56 has an upper portion with opposed recesses 58 therein for engagement with the inwardly extending flanges 24 of one of the openings 20. Note FIG. 6. The slide 56 allows for the child to slide outwardly of the base member 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable playground system for allowing for easy assembly and disassembly for transportation comprising, in combination:

a cylindrical base member having an open upper end, an enlarged closed lower end and a cylindrical side wall therebetween, the cylindrical side wall having four openings therethrough disposed at ninety degree intervals therearound intermediate the upper end and the lower end of the base member, each of the openings having inwardly extending flanges on opposing lower ends thereof, the cylindrical side wall having a plurality of small windows formed therethrough, the base member having a floor disposed interiorly thereof disposed at lower ends of the four openings;

a top member having a shape of a tree top, the top member having an open lower end dimensioned for removable coupling with the open upper end of the cylindrical base member, the top member having a plurality of windows formed therethrough;

a pair of holding chambers secured to an interior surface of the cylindrical side wall of the cylindrical base member extending downwardly through the floor disposed therein;

a pair of stair lengths adapted for removably coupling with two of the four openings of the cylindrical base member, the stair lengths each having an upper portion with opposed recesses therein for engagement with the inwardly extending flanges of the openings;

a ladder adapted for removably coupling with one of the four openings of the cylindrical base member, the ladder having an upper portion with opposed recesses therein for engagement with the inwardly extending flanges of one of the openings; and a slide adapted for removably coupling with one of the four openings of the cylindrical base member, the slide having an upper portion with opposed recesses therein for engagement with the inwardly extending flanges of one of the openings.

2. A portable playground system comprising:

a cylindrical base member having four openings therethrough disposed at ninety degree intervals therearound intermediate upper and lower ends thereof, the base member having a floor disposed interiorly thereof disposed at lower ends of the four openings;

a top member dimensioned for removable coupling with the upper end of the cylindrical base member;

climbing and descending means adapted for removably coupling with the four openings; and a pair of holding chambers secured to an interior surface of the cylindrical base member extending downwardly through the floor disposed therein.

3. The system as set forth in claim 2 wherein each of the openings of the cylindrical base member having inwardly extending flanges on opposing lower ends thereof.

4. The system as set forth in claim 3 wherein the climbing and descending means having an upper portion with opposed recesses therein for engagement with the inwardly extending flanges of one of the openings.

5. The system as set forth in claim 2 and further including a plurality of small windows formed through the cylindrical base member.

6. The system as set forth in claim 2 and wherein the top member having a plurality of windows formed therethrough.

7. The system as set forth in claim 2 wherein the climbing and descending means including at least one length of stairs.

8. The system as set forth in claim 2 wherein the climbing and descending mean including at least one ladder.

9. The system as set forth in claim 2 wherein the climbing and descending means including at least one slide.

* * * * *